US005758511A

United States Patent [19]

Yoho et al.

[11] Patent Number: 5,758,511

[45] Date of Patent: Jun. 2, 1998

[54] DESICCANT MULTI-DUEL HOT AIR/WATER AIR CONDITIONING SYSTEM

[76] Inventors: Robert W. Yoho; Robert Yoho, Jr., both of 5812 Toucan Pl., Clearwater, Fla. 34620; Jose M. Moratalla, P.O. Box 2603, Dunedin, Fla. 34697-2603

[21] Appl. No.: 321,533

[22] Filed: Oct. 11, 1994

Related U.S. Application Data

[63] Continuation-in-part of Ser. No. 131,853, Oct. 4, 1993, Pat. No. 5,353,606, which is a continuation of Ser. No. 983,279, Nov. 30, 1992, which is a continuation of Ser. No. 776,646, Oct. 15, 1991.

[51] Int. Cl.[6] ..... B25B 25/00

[52] U.S. Cl. ..... 62/271; 62/94

[58] Field of Search ..... 62/271, 94, 235.1, 62/304, 446

[56] References Cited

U.S. PATENT DOCUMENTS

| | | | |
|---|---|---|---|
| 2,811,223 | 10/1957 | Newton | 62/271 |
| 3,247,679 | 4/1966 | Meckler | 62/271 |
| 3,350,892 | 11/1967 | Kelley | 62/271 |
| 3,488,971 | 1/1970 | Meckler | 62/271 |
| 5,191,771 | 3/1993 | Meckler | 62/271 |
| 5,353,606 | 10/1994 | Yoho et al. | 62/271 |

*Primary Examiner*—William Doerrler

[57] ABSTRACT

An apparatus and method is disclosed for an improved air conditioning system for admitting air from an exterior space, adjusting the temperature and humidity of the exterior air, delivering the adjusted air to an interior space of a structure, removal of exhaust air therefrom and return of the exhaust air to the exterior space and wherein a regenerative desiccant is provided for removing water vapor from the air to be delivered to the interior space and delivering the water vapor to the exhaust air stream and a heat exchanger is provided for removing sensible heat4 from the air to be delivered to the interior space and transferring the sensible heat to the exhaust air stream.

The apparatus combines for the first time electric air conditioning reheat and solar energy with desiccant technology, thereby furnishing conditioned air at an 80% reduction fo energy cost. The apparatus for the first time allows the use of waste oil heat to furnish conditioned air at an 80% reduction in energy cost. Additionally, natural gas or propane gas may be used at a great reduction in erngy cost vs. electrical cost. The apparatus allows the reduction in electrical power presently used to condition air for use in a give space.

3 Claims, 6 Drawing Sheets

DESICCANT WITH A PACKAGE COOLING TOWER

DESICCANT WITH A PACKAGE COOLING TOWER

DESICCANT WITH SPLIT COOLING TOWER

DESICCANT MULTI-DUEL HOT AIR/WATER AIR CONDITIONING SYSTEM

RELATED APPLICATIONS

This is a continuation-in-part of U.S. application Ser. No. 08/131,853, filed Oct. 4, 1993 now U.S. Pat. No. 5,353,606, which is a continuation application of U.S. application Ser. No. 07/983/279, filed Nov. 30, 1992, which is a continuation application of U.S. application Ser. No. 07/776,646, filed Oct. 15, 1991.

BACKGROUND OF THE INVENTION

1. Field of the Invention

This invention relates to an improved air conditioning system, and more particularly to a regenerative desiccant based temperature and humidity controlling system.

2. Description of the Background Art

Presently, the need to control the temperature and humidity of the interior spaces of structures has risen to prominence as an absolute necessity for both man and machine. Modern electrical, mechanical and electronic devices generate substantial quantities of heat, but may be intolerant of extreme temperatures, as is the case with modern electronic devices. Further, the effects of temperature and humidity extremes on the comfort and productivity of man is a fundamentally accepted principle. Environmental control, when originally established and as it progressed, was not mandated to address the issue of energy conservation since there was an abundance of energy at reasonable cost. As the energy supply became more acute, the demand increased and energy costs escalated, a new energy awareness was established, wherein more complex and expensive equipment could easily be justified if a net energy savings could be realized by purchase and use of this new equipment.

The original equipment to control the environment used refrigeration equipment to cool the air and for dehumidification and a variety of mechanisms, devices, and fuels to heat the air to the desired temperature. The use of desiccating materials and heat exchangers to control the temperature and humidity of interior spaces advanced the state of the art and provided more energy efficient mechanisms.

A wide variety of air conditioning systems have evolved and have been developed, however, system improvements have been incremental and systems developed using the prior art have not fully answered the needs of efficient energy conservation and still providing adequate environmental control of interior spaces.

As evidenced by a large number of prior art patents, efforts are continuing to improve air conditioning systems. Consider for example, U.S. Pat. No. 4,719,761 to Cromer discloses moisture removal by a combination of regenerative desiccation and a standard compressor type air cooling system, wherein moisture removed from cooled air by means of a solid or liquid desiccant is evaporated into the incoming air, regenerating the desiccant. Moisture removal is effected by the compressor type cooling system and the regenerated desiccant.

U.S. Pat. No. 2,926,502 to Munters et al discloses an air conditioning system including the recycling of enclosure and air at least 3 air flow paths. Recycle enclosure air multiple passages—all embodiments including a recycling of interior space conditioned air path, a regeneration air path and a supplementary air path for additional heat exchange.

U.S. Pat. No. 3,009,684 to Munters discloses an apparatus and method of conditioning air by thermodynamic exchange wherein the input heat required by the system may be provided by gas, oil or steam. Parallel air paths are described wherein a first path removes interior air and a second path delivers conditioned air to the interior space to be environmentally controlled, plus a third path wherein incoming air is divided and is used to regenerate a second moisture transfer wheel. A second heat transfer wheel and heater system are also provided in this third path.

U.S. Pat. No. 4,594,860 to Coellner et al discloses an open cycle desiccant air conditioning system and associated components.

Both moisture transfer and heat exchanger wheels utilized are formed by wrapping layers of the appropriate material about a shaft, and terminating with the installation of a metallic rim. Moisture transfer and heat exchanger wheels rotate in opposite directions, and a sector baffle system is provided to direct air flow from the moisture transfer wheel containing an appropriate desiccant and the heat transfer wheel.

U.S. Pat. No. 2,186,844 to Smith discloses a refrigeration apparatus wherein heat from a mechanical refrigeration unit regenerates desiccant.

U.S. Pat. No. 2,200,243 to Newton et al discloses an air conditioning system dehumidification of the air is required and particularly addresses a control system for a desiccant based dehumidifying air conditioning system U.S. Pat. No. 3,144,901 to Meek discloses an air conditioning system wherein a rotary evaporator and heat transfer system is followed by additional evaporative cooling to further reduce temperature and increase humidity to normal levels. The system circulates fresh outside air into the interior space and exhausts air to exterior spaces. Regeneration heat is provided by burners utilizing any suitable fuel and has U-shaped flue tubes to heat air passing through the moisture transfer wheel.

U.S. Pat. No. 2,186,844 to Smith discloses an air conditioning system wherein heat from a mechanical refrigeration unit regenerates the LiCl desiccant impregnated on vertical cloth rotating wheel.

U.S. Pat. No. 3,247,679 to Meckler discloses a process and apparatus for cooling and dehumidifying air wherein exhaust heat from a heat engine whose shaft power drives refrigeration equipment is used to regenerate the desiccant.

U.S. Pat. No. 3,488,971 to Meckler discloses a system for supplying comfort conditioned air to an interior space wherein a heat recapture system for lighting is described to provide regeneration heat for a desiccant.

As will become evident, nothing in the prior art provides the benefits and advantages attendant with the present invention.

Accordingly, it is an object of this invention to provide an improvement which overcomes the aforementioned inadequacies of the prior art devices and provides an improvement which is a significant contribution to the advancement of the art.

Another object of the invention is to provide an improved air conditioning system for admitting air from an exterior space, adjusting the temperature and humidity of the exterior air, delivering the adjusted air to an interior space of a structure, subsequent removal of exhaust air from the interior space and return of the exhaust air to the exterior space.

Another object of the present invention is to provide an improved air conditioning system wherein a humidifying means is disposed to and in communication with a heating means and with the conditioned air exit means is provided for receiving the temperature adjusted reduced water vapor content air from the heating means, for upwardly adjusting the water vapor content of the air, and for delivery of the temperature and humidity of the air, and for delivery of the temperature and humidity adjusted air to the conditioned air exit means.

Another object of the present invention is to provide an improved air conditioning system wherein more economical operation, lower maintenance costs, and lower weight are provided relative to conventional air conditioning systems.

Another object of the invention is to provide an improved air conditioning system wherein a safe efficient means is provided to convert environmentally hazardous waste products including waste oil into cooling and heating energy.

The foregoing has outlined some of the pertinent objects of the invention. These objects should be construed to merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a new and improved method and apparatus for an air conditioning system for admitting air from an exterior space, adjusting the temperature and humidity of the exterior air, delivering the adjusted air to an interior space of a structure, removal of exhaust air therefrom and return of the exhaust air to the exterior space. An air intake means if provided for admitting the exterior air to an exterior air supply blower means which pressurizes and moves the exterior air through the supply system. A desiccant means having a desiccating area and a regeneration area is provided wherein the desiccating area communicates with the exterior air supply blower means and receives the pressurized exterior air from the exterior air supply blower means for reducing the humidity of the exterior air passing therethrough. A heat exchanger means having a cooled area and a heated area is provided wherein the cooled area of the heat exchanger means communicates with the desiccant means for receiving the exterior air with reduced water vapor content from the desiccant means and wherein the heat exchanger means downwardly adjusts the temperature of air displaced therethrough. A heating means is provided which communicates with the heat exchanger means for receiving the cooled reduced water vapor content air from the heat exchanger means for optionally and seasonally upwardly adjusting the temperature of air displaced therethrough. A conditioned air exit means communicating with the interior space of a structure for delivery of the conditioned air thereto.

The system provides an exhaust air intake means for removing air from the interior space of a structure, and wherein the exhaust air passes over and removes heat from the heated area of the heat exchanger means and the regeneration area of the desiccant means communicates with the heated area of the heat exchanger means for regeneration of the desiccant means by vaporization of water and subsequent removal. An exhaust air blower means communicating with the regeneration means is provided for receiving and moving exhaust air from the regeneration means to an exhaust air exit means for delivery of the exhaust air to the exterior.

In a more specific embodiment of the invention, a humidifying means disposed to and communicating with the heating means and with the conditioned air exit means is provided for receiving the temperature adjusted, reduced water vapor content air from the heating means, for upwardly adjusting the water vapor content of the air, and for delivery of the temperature and humidity adjusted air to the conditioned air exit means.

In one embodiment of the invention, an evaporative cooling means, disposed to and communicating with the exhaust air intake means and with the regeneration means, is provided for evaporatively cooling the exhaust air.

In one embodiment of the invention, the regeneration means comprises a finned tube liquid to air heat exchanger wherein the heated liquid is provided by a boiler fueled by combustible fuels including gas, oil, waste oil or the like.

In another embodiment of the invention, the regeneration means comprises a finned tube liquid to air heat exchanger wherein the heated liquid is provided by a solar heating means.

In a more specific embodiment of the invention, the regeneration means comprises a fined tube liquid to air heat exchanger wherein the heated liquid is provided by an internal combustion engine cooling system means.

In a more specific embodiment of the invention, a plenum means is provided for mounting the air conditioning system, for admitting the adjusted air from the conditioned air exit means to an interior space of a structure, for removal of exhaust air from an interior space of a structure for delivery of the exhaust air to an exhaust air intake means of the air conditioning system.

In another embodiment of the invention, the regulation of the desiccant material is provided by the existing air conditioning systems by routing the hot gas through coils in the invention and also an additional coil in which a solar liquid is circulated to provide heat for regeneration. Additionally, spray heads or evaporator pads are placed in heat exchanger air stream to treat the air before reaching the heat exchanger wheel this process further reduces the supply air temperature to the interior space.

Additionally, another embodiment of this invention is the use of silicagel or zeolite wheel using a direct or indirect fired gas or waste oil or oil burner to super heat the desiccant for regeneration to temperatures exceeding 300 degrees fahrenheit as to lower constant humidity to the space below 20% RH for specialized hi-tech and industrial applications.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several Figures.

DETAILED DESCRIPTION OF THE PREFERRED EMBODIMENT

Figure 1:
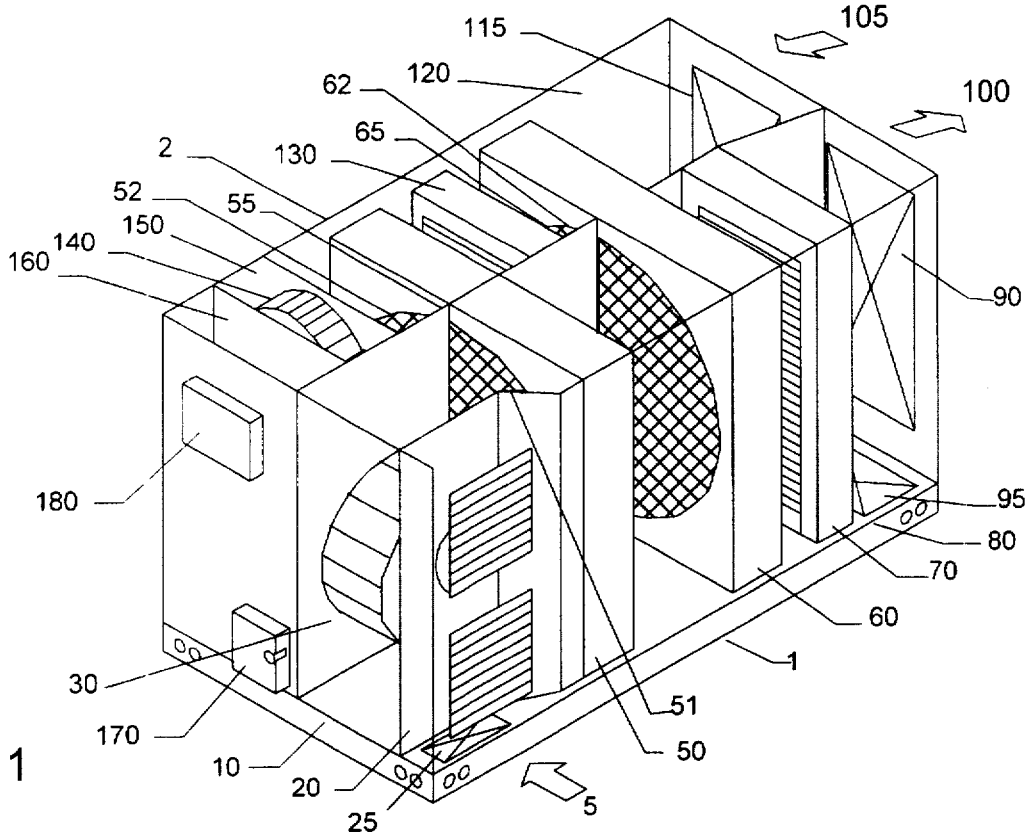
FIG. 1 is an isometric view of a first embodiment of an improved air conditioning system incorporating the present invention.
Figure 2:
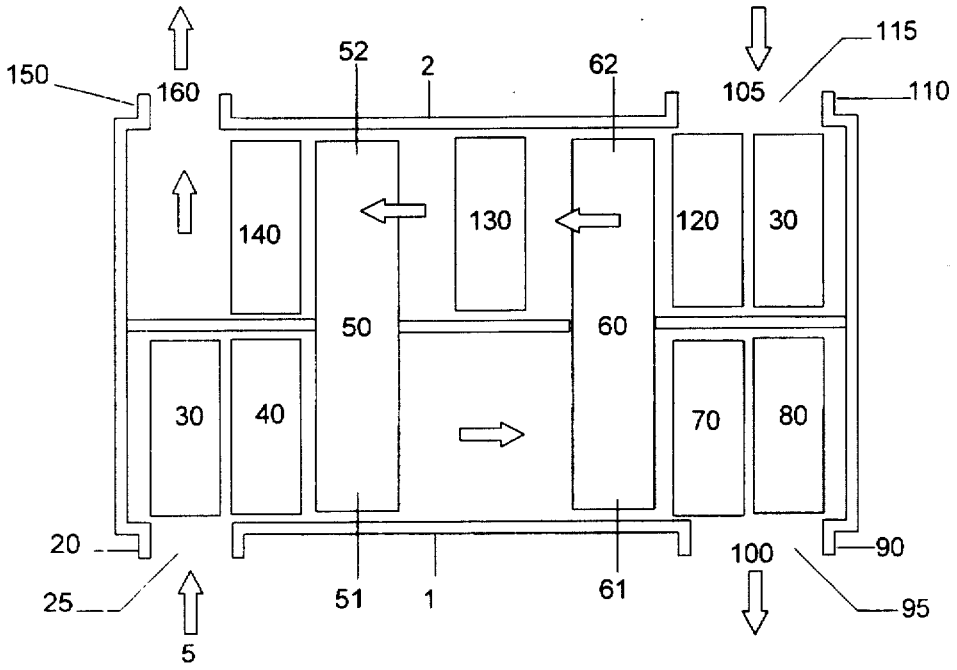
FIG. 2 is a block diagram of a first embodiment of an improved air conditioning system incorporating the present invention.

FIG. 1 is an isometric view and FIG. 2 is a block diagram of a first embodiment of an improved air conditioning system incorporating the present invention, wherein system components are affixed to chassis. System input air 5, comprising unconditioned outside air, return air, or any combination thereof, is drawn through outside air intake 20 and air filter 30 by means of suction provided by forced air intake blower 40. An optional return/mixing air port 25 is provided in chassis 10. Forced air intake blower 40 further forces system input air 5 through desiccant wheel 50, rotary regenerative heat exchanger wheel 60, heating coil 70, optional humidifier 80, and side discharge port 90. Alternately, an optional discharge port 95 is provided in chassis 10 to allow discharge of conditioned air 100 for delivery to an interior space. Return air 105, comprising return air from an interior space. Return air 105, comprising return air from an interior space, outside air, or any combination thereof is drawn through outside/return air port 110 by means of suction provided by forced air exhaust blower 140. An optional return air port 115 is provided in chassis 10 for return air 105 from an interior space. Air exhaust blower 140 further draws return air 105 through air filter 30, optional evaporative elements 120, rotary regenerative heat exchanger wheel 60, regeneration coil 130, desiccant wheel 50, through air exhaust air port 150 to exterior space. Required electrical disconnect 170 and control section 180 are also provided. Control section 180 comprises required control circuitry, sensors, plumbing and wiring necessary for proper system operation. Desiccant wheel rotary motive power and mechanical apparatus 190 as well as heat exchanger rotary motive power and mechanical apparatus 200 are not shown. The system and apparatus is substantially divided into a supply section 1, which conditions system input air 5, and an exhaust section 2 which removes air from the interior space and reconditions the desiccant wheel 50 and the rotary regenerative heat exchanger wheel 60.

In the cooling cycle, unconditioned system input air 5 enters the outside air intake 20 and passes through a high efficiency disposable air filter 30, which is typically a disposable pleated type air filter which essentially removes all particulate matter larger than 5 microns, and may be treated to capture bacteria and other contaminants. Forced air intake blower 40, which may be belt or direct motor driven, draws filtered system input air 5 from air filter 30, pressurizes it and forces the filtered system input air 5 through the balance of the supply section 1. Axially and rotatably mounted, motor and belt drive desiccant wheel 50, comprising liquid or dry desiccants disposed to metallic or fiberglass reinforced plastic base material, is substantially equally divided into a supply sector 51 and an exhaust sector 52, by means of duct/seal 55 comprising a substantially air tight seal between the supply sector 51 and exhaust sector 52 of desiccant wheel 50. Filtered system input air 5 passes through the supply sector 51 if desiccant wheel 50 where water vapor, contained in filtered outside air 5, is absorbed by the desiccant material comprising the supply sector 51 of desiccant wheel 50. The process of water vapor removal releases latent heat of vaporization, resulting in heating of filtered dehumidified system input air 5.

Axially and rotatably mounted and motor driven rotary generative heat exchanger wheel 60, comprising a metallic or fiberglass reinforced plastic material, is substantially equally divided into a supply sector 61 and an exhaust sector 62, by means of duct/seal 65 comprising a substantially air tight seal between the supply sector 61 and exhaust sector 62 of rotary regenerative heat exchanger wheel 60. The filtered, dehumidified, heated system input air 5 passes through the supply sector 61 of the rotary regenerative heat exchanger wheel 60 and heat contained in filtered, dehumidified, heated system input air 5 is transferred to the structure of the rotary regenerative heat exchanger wheel 60, lowering the temperature of the filtered, dehumidified system input air 5.

The filtered, dehumidified, cooled system input air 5 has been reduced to a low enthalpy or energy content and may be humidified by means of optional humidifier coil 80. This addition of water vapor effectively substitutes increased humidity for reduced temperature and does not alter the enthalpy value. Conditioned air 100 exits side discharge port 90 at temperature, humidity, and enthalpy values substantially identical with those provided by conventional vapor compression devices. Discharge port 90 disposed to conventional HVAC duct work provides the pathway for conditioned air 100 to enter interior space.

Outside/return air port 110 disposed to conventional HVAC duct work provides the pathway for return air 105 to exit interior space and enter exhaust section 2 of the apparatus through air filter 30, wherein evaporative cooling element 120 optionally evaporatively cools return air 105. Return air 105 flows through the rotary regenerative heat exchanger wheel 60, removing heat and lowering the temperature of the structure. As rotary regenerative heat exchanger wheel 60 axially rotates heat is transferred from filtered, heated system input air 5 in supply section 1 to supply sector 51 structure of rotary regenerative heat exchanger wheel 60. Continued rotation of rotary regenerative heat exchanger wheel 60 continually moves increments of supply sector 51 through duct/seal 65 into exhaust sector 62, wherein heat is removed and the temperature of the exhaust sector 62 of rotary regenerative heat exchanger wheel 60 is lowered. Further rotation of rotary regenerative heat exchanger wheel 60 returns increments of exhaust sector 62 through duct/seal 65 into supply sector 61. Return air 105 heated by contact with exhaust sector 62 of rotary regenerative heat exchanger wheel 60 is further heated as return air 105 passes through regeneration coil 130 comprising a finned tube liquid to air heat exchanger. The fluid heat source may be a variety of heat producing mechanisms. These mechanism include, but are not limited to boilers fired by gas, oil, or waste oil; solar; or heat reclaimed from an engine cooling system.

The heated return air 105 flows through the exhaust sector 52 of desiccant wheel 50, heating and drying, thereby regenerating, the desiccant. Continued rotation of desiccant wheel 50 continually moves increments of supply sector 51 through duct/seal 55 into exhaust sector 52, wherein moisture is removed from exhaust sector 52 of desiccant wheel 50. Further rotation of desiccant wheel 50 returns increments of exhaust sector 52 of desiccant wheel 50 through duct/seal 55 into supply sector 51 of desiccant wheel 50. Moisture laden exhaust air 160 passes through exhaust air blower 140 and exits the apparatus to exterior space through exhaust air port 150.

In the heating mode, the optional evaporative elements 120 and desiccant wheel 50 are disabled and regeneration coil 130 is disabled by diversion of heated fluid flow to heating coil 70. System input air 5 enters the outside air intake 20 and passes through air filter 30. Forced air intake blower 40 draws filtered system input air 5 from air filter 30, pressurizes it and forces the filtered system input air 5 through the balance of the supply section 1. Desiccant wheel 50 is disabled, and does not substantially alter the temperature, moisture content or enthalpy of system input air 5 passing therethrough. The filtered system input air 5 passes through the supply sector 61 of the rotary regenerative heat exchanger wheel 60 and heat contained in the structure of the rotary regenerative heat exchanger wheel 60 is transferred to and increase the temperature of the filtered system input air 5. The filtered heated system input air 5 is further heated as it passes through heating coil 70, comprising a liquid to air heat exchanger, wherein heated liquid may be provided by, but are not limited to, boilers fired by gas, oil, or waste oil; solar; or heat reclaimed from an engine cooling system. Humidification of system input air 5 is optionally performed by humidifier coil 80. Conditioned air 100 exits side discharge port 90 disposed to conventional HVAC duct work provides the pathway for conditioned air 100 to enter interior space.

Return air port 110 disposed to conventional HVAC duct—work provides the pathway for return air 105 to exit interior space and enter exhaust section 2 of the apparatus through air filter 30. Evaporative cooling element 120 is disabled, and does not substantially alter the temperature, moisture content or enthalpy of return air 105 passing therethrough. Return air 105 flows through the rotary regenerative heat exchanger wheel 60 and transfers heat thereto, removing heat and lowering the temperature of the return air 105 and increases the temperature of the rotary regenerative heat exchanger wheel 60. As rotary regenerative heat exchanger wheel 60 axially rotates heat is transferred from return air 105 in exhaust section 2 to exhaust sector 62 structure of rotary regenerative heat exchanger wheel 60. Continued rotation of rotary regenerative heat exchanger wheel 60 continually moves increments of exhaust sector 62 through duct/seal 65 into supply sector 61, wherein heat is transferred to system input air 5 and the temperature of the supply sector 61 of rotary regenerative heat exchanger wheel 60 is lowered. Further rotation of rotary regenerative heat exchanger wheel 60 returns increments of supply sector 61 through duct/seal 65 into exhaust sector 62. Contact of return air 105 with exhaust sector 62 of rotary regenerative heat exchanger wheel 60 results in heating of structure of exhaust sector 62 of rotary regenerative heat exchanger wheel 60. Return air 105 passes through the disabled degeneration coil 13 and desiccant wheel 50 and the temperature, moisture content or enthalpy of system input air 5 passing therethrough is not substantially altered. Return air 105 passes through exhaust air blower 140 and exits the apparatus to exterior space through exhaust air port 150.

With a 0 degree Fahrenheit exterior temperature a typical system would provide heating performance of 120 to 140 degrees Fahrenheit air for delivery to the interior spaces. Return air 105 of 70 degrees Fahrenheit at rotary regenerative heat exchanger wheel 60 will heat outside air at 0 degrees Fahrenheit to 64.4 degrees Fahrenheit.

Figure 3:
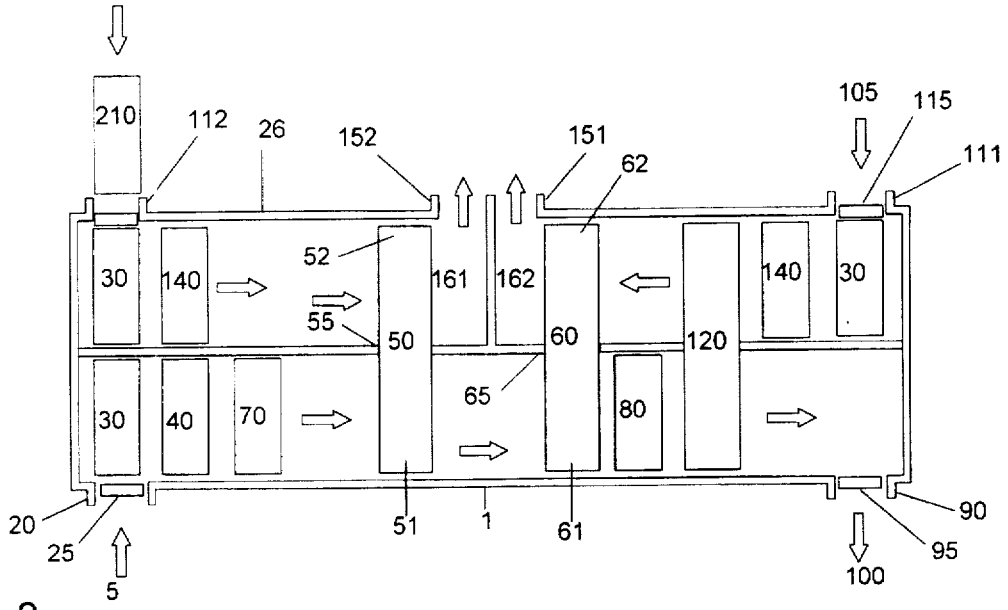
FIG. 3 is a block diagram of a second embodiment of an improved air conditioning system incorporating the present invention.

FIG. 3 is a block diagram of a second embodiment of an improved air conditioning system incorporating the present invention, wherein system components are affixed to chassis 10. The system and apparatus is substantially divided into a supply section 1, which conditions system input air 5, and an exhaust section 2 which is further subdivided into a heat exchanger exhaust section **2*a* and a desiccant exhaust section 2*b*. System input air 5, comprising unconditioned outside air, return air, or any combination thereof, is drawn through outside air intake 20 and air filter 30 by means of suction provided by forced air intake blower 40. An optional return/mixing air port 25 is provided in chassis 10. Forced air intake blower 40 further forces system input air 5 through heating coil 70, desiccant wheel 50, rotary regenerative heat exchanger wheel 60, optional evaporator elements 120, optional humidifier 80, and side discharge port 90. Alternately, an optional discharge port 95 is provided in chassis 10 to allow discharge of conditioned air 100** for delivery to an interior space.

In heat exchanger exhaust section **2*a*, return air 105, comprising return air from an interior space, outside air, or any combination thereof is drawn through heat exchanger return air port 111 by means of suction provided by forced air exhaust blower 140. An optional return air port 115 is provided in chassis 10 for return air 105 from an interior space. Air exhaust blower 140 further draws return air 105 through air filter 30, air exhaust blower 140, and forces return air 105 through optional evaporative elements 120, rotary regenerative heat exchanger wheel 60, through heat exchanger exhaust air port 151 wherein heat exchanger exhaust air 161** exits to exterior space.

In desiccant exhaust section **2*b*, return air 105, comprising return air from an interior space, outside air, or any combination thereof is drawn through and heated by enclosed burner 210, drawn through desiccant exhaust return air port 112 by and filter 30 by means of suction provided by forced air exhaust blower 140, which further forces return air 105 through desiccant wheel 50, and desiccant exhaust air 162 exits system through desiccant exhaust port 152**.

Required electrical disconnect 170 and control section 180 comprising required control circuitry, sensors, plumbing and wiring necessary for proper system operation, desiccant wheel rotary motive power and mechanical apparatus 190 as well as heat exchanger rotary motive power and mechanical apparatus 200 are also provided, but not shown.

In the heating mode, the optional evaporative elements 120, desiccant wheel 50, and desiccant exhaust section **2*b* are disabled. System input air 5 enters the outside air intake 20 and passes through air filter 30. Forced air intake blower 40 draws filtered system input air 5 from air filter 30, pressurizes it and forces the filtered system input air 5 through the balance of the supply section 1. The filtered heated system input air 5 is further heated as it passes through heating coil 70, wherein enclosed burner 210 provides heat to heating coil 70. Desiccant wheel 50 is disabled, and does not substantially alter the temperature, moisture content or enthalpy of system input air 5 passing therethrough. Axially and rotatably mounted and motor driven rotary regenerative heat exchanger wheel 60 is substantially equally divided into a supply sector 61 and an exhaust sector 62. The filtered system input air 5 passes through the supply sector 61 of the rotary regenerative heat exchanger wheel 60 and heat contained in the structure of the rotary regenerative heat exchanger wheel 60 is transferred to and increases the temperature of the filtered system input air 5. Conditioned air 100 exits side discharge port 90 disposed to conventional HVAC duct work provides the pathway for heated, conditioned air 100** to enter interior space.

In heat exchanger exhaust section 2*a*, return air 105 is drawn through heat exchanger return air port 111 and filter 30 by means of suction provided by forced air exhaust blower 140. Air exhaust blower 140 further forces return air 105 through disabled optional evaporative elements 120, rotary regenerative heat exchanger wheel 60, wherein return air 105 passes through the exhaust sector 62 of the rotary regenerative heat exchanger wheel 60 transferring heat to the structure of the rotary regenerative heat exchanger wheel 60, forcing heat exchanger exhaust air 161 through heat exchanger exhaust air port 151 to exterior space.

Figure 4:
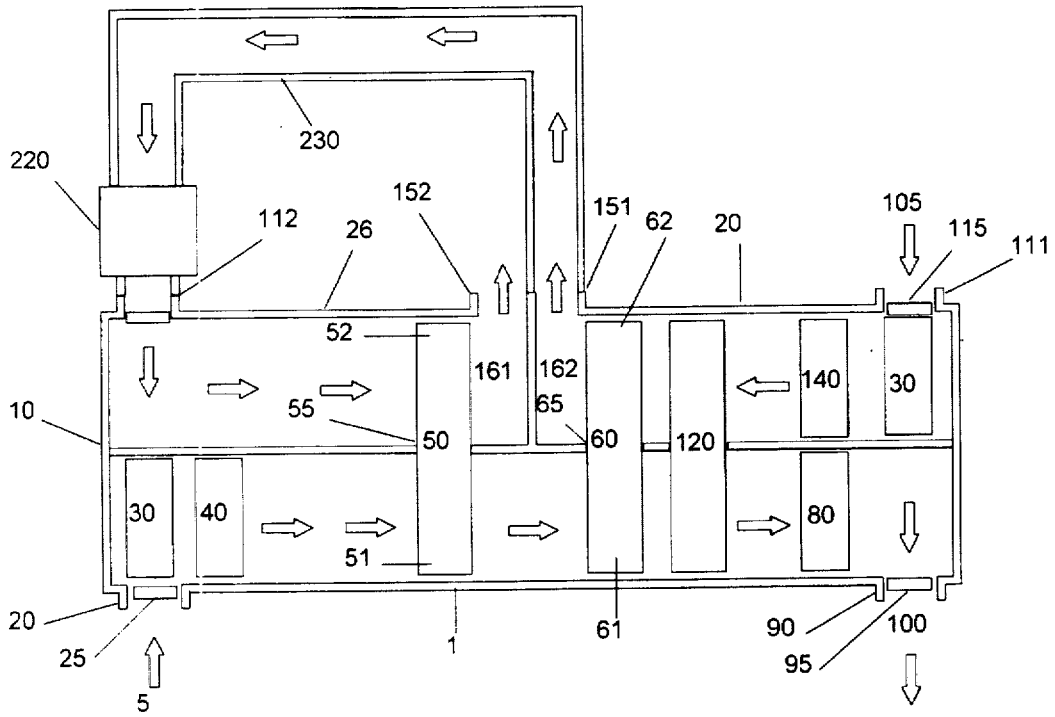
FIG. 4 is a block diagram of a third embodiment of an improved air conditioning system incorporating the present invention.

FIG. 4 is a block diagram of a third embodiment of an improved air conditioning system incorporating the present invention, wherein system components are affixed to chassis 10. The system and apparatus is substantially divided into a supply section 1, which conditions system input air 5, and an exhaust section 2 which is further subdivided into a heat exchanger exhaust section 2*a* and a desiccant exhaust section 2*b*. In the cooling cycle, wherein component function has been described in FIG. 2, system input air 5, comprising unconditioned outside air, return air, or any combination thereof, is drawn through outside air intake 20 and air filter 30 by means of suction provided by forced air intake blower 40. An optional return/mixing air port 25 is provided in chassis 10. Forced air intake blower 40 further forces system input air 5 through desiccant wheel 50, rotary regenerative heat exchanger wheel 60, optional evaporator elements 120, optional humidifier 80, and side discharge port 90. Alternately, an optional discharge port 95 is provided in chassis 10 to allow discharge of conditioned air 100 for delivery to an interior space.

In heat exchanger exhaust section 2*a*, return air 105, comprising return air from an interior space, outside air, or any combination thereof is drawn through heat exchanger return air port 111 by means of suction provided by forced air exhaust blower 140. An optional return air port 115 is provided in chassis 10 for return air 105 from an interior space. Air exhaust blower 140 further draws return air 105 through air filter 0, air exhaust blower 140, and forces return air 105 through optional evaporative elements 120, rotary regenerative heat exchanger wheel 60, through heat exchanger exhaust air port 151 wherein heat exchanger exhaust air 161 enters recirculation duct 230 and flows into natural gas furnace 220, wherein heat exchanger exhaust air 161 is further heated, and flows into desiccant exhaust section 2*b*. Heat exchanger exhaust air 161 is further forced through desiccant exhaust return air port 112, desiccant wheel 50, and desiccant exhaust air 162 exits system through desiccant exhaust port 152.

Required electrical disconnect 170 and control section 180 comprising required control circuitry, sensors, plumbing and wiring necessary for proper system operation, desiccant wheel rotary motive power and mechanical apparatus 190 as well as heat exchanger rotary motive power and mechanical apparatus 200 are also provided, but not shown.

In the operation of heat exchanger exhaust section 2*a*, return air 105 is drawn into heat exchanger return air port 111 through air filter 30, by action of exhaust air blower 140, further forcing return air 105 through optional evaporative elements 120 wherein return air 5 is evaporatively cooled, through rotary regenerative heat exchanger wheel 60, wherein cooled return air 105 removes heat and lowers the temperature of the structure of rotary regenerative heat exchanger wheel exhaust sector 62 of rotary regenerative heat exchanger wheel 60, as previously described under FIG. 2, and heat exchanger exhaust air 161 is discharged to an exterior space through heat exchanger exhaust air port 151.

In the operation of desiccant exhaust section 2*b*, system input air 5 is heated by enclosed burner 210, drawn into desiccant exhaust intake 112, through air filter 30, by action of exhaust air blower 140, further forcing heated system input air 5 through the exhaust sector 52 of desiccant wheel 50, heating and drying, thereby regenerating the desiccant and desiccant exhaust air 162 is discharged to an exterior space through heat exchanger exhaust air port 152.

In the heating mode, the optional evaporative elements 120, desiccant wheel 50, and desiccant exhaust section 2*b* are disabled. System input air 5 enters the outside air intake 202,3,4 and passes through air filter 30. Forced air intake blower 40 draws filtered system input air 5 from air filter 30, pressurizes it and forces the filtered system input air 5 through the balance of the supply section 1. The filtered heated system input air 5 is further heated as it passes through heating coil 70, wherein enclosed burner 210 provides heat to heating coil 70. Desiccant wheel 50 is disabled, and does not substantially alter the temperature, moisture content or enthalpy of system input air 5 passing therethrough. Axially and rotatably mounted and motor driven rotary regenerative heat exchanger wheel 60 is substantially equally divided into a supply sector 61 and an exhaust sector 62. The filtered system input air 5 passes through the supply sector 61 of the rotary regenerative heat exchanger wheel 60 and heat contained in the structure of the rotary regenerative heat exchanger wheel 60 is transferred to and increases the temperature of the filtered system input air 5. Conditioned air 100 exits side discharge port 90 disposed to conventional HVAC duct work provides the pathway for heated, conditioned air 100 to enter interior space.

In heat exchanger exhaust section 2*a*, return air 105 is drawn through heat exchanger return air port 111 and filter 30 by means of suction provided by forced air exhaust blower 140. Air exhaust blower 140 further forces return air 105 through disabled optional evaporative elements 120, rotary regenerative heat exchanger wheel 60, wherein return air 105 passes through the exhaust sector 62 of the rotary regenerative heat exchanger wheel 60 transferring heat to the structure of the rotary regenerative heat exchanger wheel 60, forcing heat exchanger exhaust air 161 through heat exchanger exhaust air port 151 to exterior space.

Figure 5:
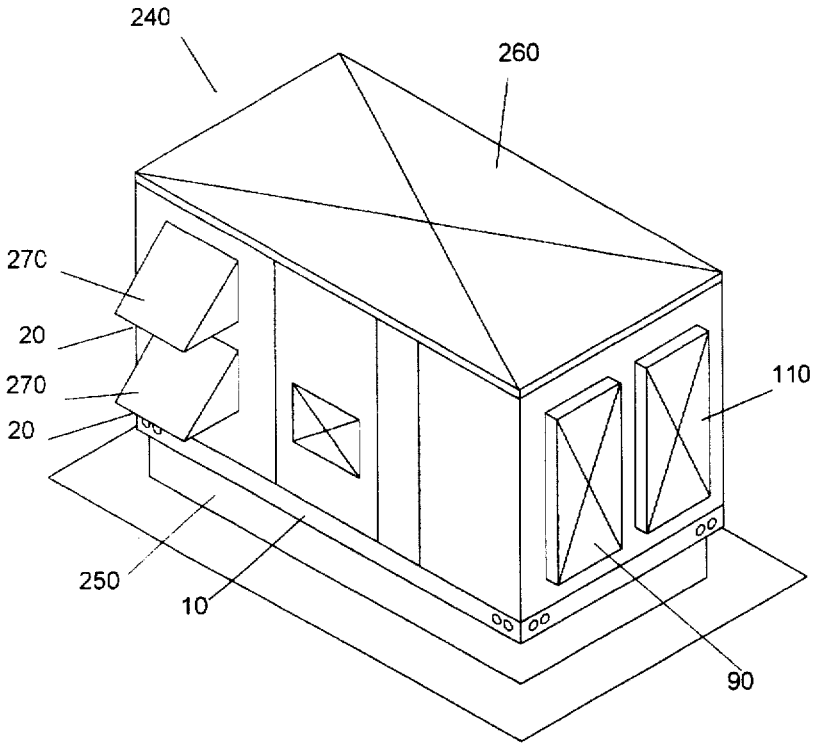
FIG. 5 is an isometric view of an embodiment of an improved air conditioning system mounted on a plenum means incorporating the present invention.

FIG. 5 is an isometric view of an embodiment of an improved air conditioning system mounted on a plenum means incorporating the present invention, wherein cover housing 260, fabricated to protect components from mechanical damage or elemental degradation, of air conditioning system 240 is affixed to chassis 10. Plenum/curb 250 affixed to structure roof 280 provides a mounting platform for chassis 10 of air conditioning system 240. Plenum/curb 250 described in U.S. Pat. No. 4,403,481 provides a pathway for communication between supply and return air and air conditioner 240 when used in conjunction with optional chassis mounted return air ports 25, 115 and discharge port 95 (not shown) previously described in FIGS. 2,3,4. Weather shields 270 prevent entry of rain and other foreign materials into outside air intake 20. Side discharge port 90 and return air port 110 are illustrated in a disabled condition, with their respective functions being accepted by discharge port 95, and return air port 115 and curb/plenum 250.

Heat for regeneration of desiccant, as well as increasing supply air temperatures, as required, may be provided by:

a heated fluid, wherein fluid heat is provided by natural gas, propane, waste oil, other combustible fuels or the cooling system of an engine;

heated air, wherein the air is heated by means of a hot air furnace which may use natural gas, propane, waste oil, other combustible fuels; and direct fired burner, wherein the regeneration air is directly heated by means of a burner which may use natural gas, propane, waste oil, other combustible fuels.

Figure 6:
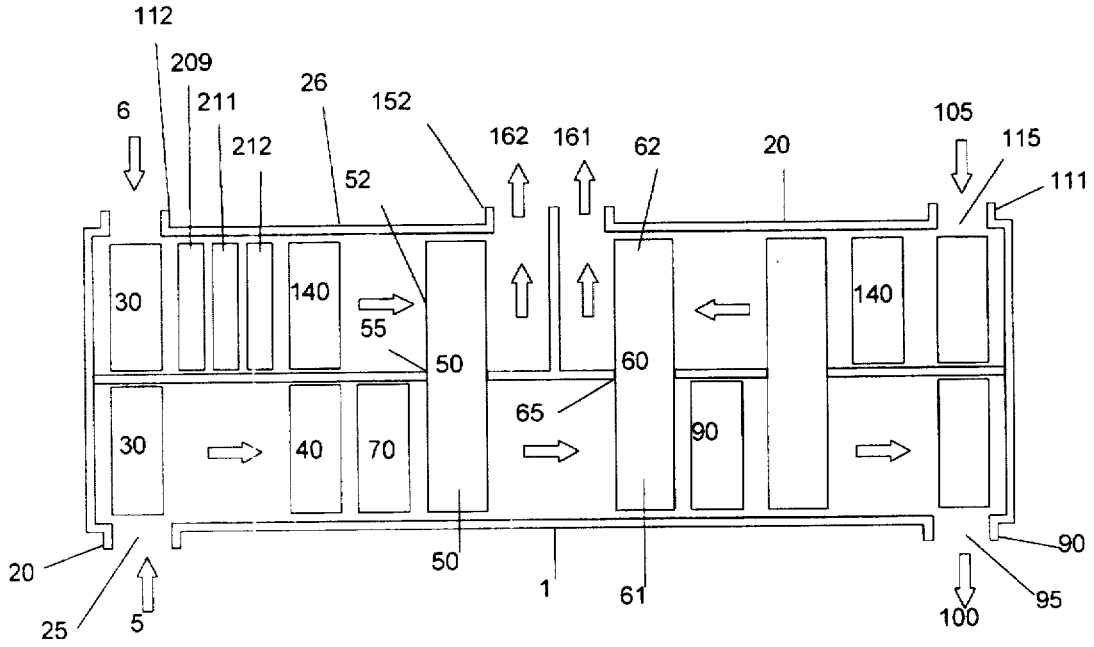
FIG. 6 is a clock diagram of a forth embodiment of an improved air conditioning system incorporating the present air conditioning system with electric air conditioning and solar energy panels.

FIG. 6 is a block diagram of a fourth embodiment of an improved air conditioning system incorporating the present invention, wherein system components are affixed to chassis 10. The system and apparatus is substantially divided into a supply section 1, which conditions system input air 5, and an exhaust section 2 which is further subdivided into a heat exchanger exhaust section 2*a* and a desiccant exhaust section 2*b*. System input air 5, comprising unconditioned outside air, return air, or any combination thereof, is drawn through outside air intake 20 and air filter 30 by means of suction provided by forced air intake blower 40. An optional return/mixing air port 25 is provided in chassis 10. Forced air intake blower 40 further forces system input air 5 through heating coil 70, desiccant wheel 50, rotary regenerative heat exchanger wheel 60, evaporator elements 120, optional humidifier 80, and side discharge port 90. Alternately, an optional discharge port 95 is provided in chassis 10 to allow discharge of conditioned air 100 for delivery to an interior space.

In heat exchanger exhaust section 2*a*, return air 105, comprising return air from an interior space, outside air, or any combination thereof is drawn through heat exchanger return air port 111 by means of suction provided by forced air exhaust blower 140. An optional return air port 115 is provided in chassis 10 for return air 105 from an interior space. Air exhaust blower 140 further draws return air 105 through air filter 30, air exhaust blower 140, and forces return air 105 through evaporative elements 120, rotary regenerative heat exchanger wheel 60, through heat exchanger exhaust air port 151 wherein heat exchanger exhaust air 161 exits to exterior space.

In desiccant exhaust section 26, return air 105, comprising return air from an interior space, outside air, or any combination thereof is drawn through return air port 112 and filter 30 and heated by Desuper heater 209 through condenser coil 211 through solar or hot water coil 212 by means of suction provided by forced air exhaust blower 140, which further forces return air 105 through desiccant wheel 50, and desiccant exhaust air 162 exits system through desiccant exhaust port 152.

Required electrical disconnect 170 and control section 180 comprising required control circuitry, sensors, plumbing and wiring necessary for proper system operation, desiccant wheel rotary motive power and mechanical apparatus 190 as well as heat exchanger rotary motive power and mechanical apparatus 200 are also provided, but not shown.

In the heating mode, the optional evaporative elements 120, desiccant wheel 50, and desiccant exhaust section 2*b* are disabled. System input air 5 enters the outside air intake 20 and passes through air filter 30. Forced air intake blower 40 draws filtered system input air 5 from air filter 30, pressurizes it and forces the filtered system input air 5 through the balance of the supply section 1. The filtered heated system input air 5 is further heated as it passes through heating coil 70, wherein enclosed burner 210 provides heat to heating coil 70. Desiccant wheel 50 is disabled, and does not substantially alter the temperature, moisture content or enthalpy of system input air 5 passing therethrough. Axially and rotatably mounted and motor driven rotary regenerative heat exchanger wheel 60 is substantially equally divided into a supply sector 61 and an exhaust sector 62. The filtered system input air 5 passes through the supply sector 61 of the rotary regenerative heat exchanger wheel 60 and heat contained in the structure of the rotary regenerative heat exchanger wheel 60 is transferred to and increases the temperature of the filtered system input air 5. Conditioned air 100 exits side discharge port 90 disposed to conventional HVAC ductwork provides the pathway for heated, conditioned air 100 to enter interior space.

In heat exchanger exhaust section 2*a*, return air 105 is drawn through heat exchanger return air port 111 and filter 30 by means of suction provided by forced air exhaust blower 140. Air exhaust blower 140 further forces return air 105 through disabled optional evaporative elements 120, rotary regenerative heat exchanger wheel 60, wherein return air 105 passes through the exhaust sector 62 of the rotary regenerative heat exchanger wheel 60 transferring heat to the structure of the rotary regenerative heat exchanger wheel 60, forcing heat exchanger exhaust air 161 through heat exchanger exhaust air port 151 to exterior space.

Figure 7:
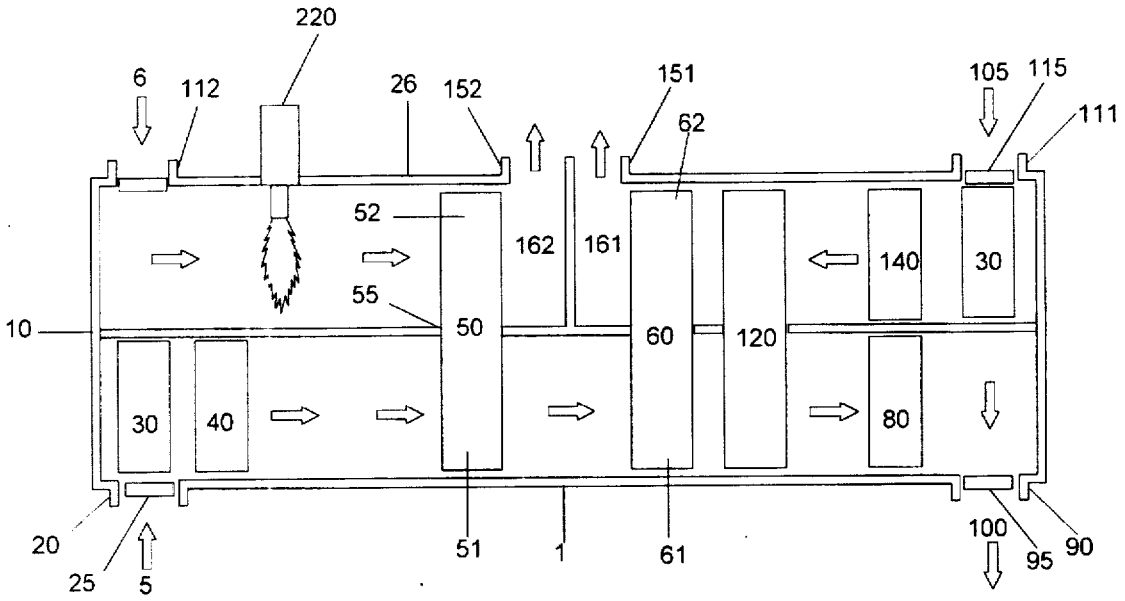
FIG. 7 is a block diagram of a fifth embodiment of an improved air conditioning system with a direct or indirect fired burner using a solid desiccant.

FIG. 7 is a block diagram of a fifth embodiment of an improved air conditioning system incorporating the present invention, wherein system components are affixed to chassis 10. The system and apparatus is substantially divided into a supply section 1, which conditions system input air 5, and an exhaust section 2 which is further subdivided into a heat exchanger exhaust section 2*a* and a desiccant exhaust section 2*b*. In the cooling cycle, wherein component function has been described in FIG. 2, system input air 5, comprising unconditioned outside air, return air, or any combination thereof, is drawn through outside air intake 20 and air filter 30 by means of suction provided by forced air intake blower 40. An optional return/mixing air port 25 is provided in chassis 10. Forced air intake blower 40 further forces system input air 5 through desiccant wheel 50, rotary regenerative heat exchanger wheel 60, evaporator elements 120, optional humidifier 80, and side discharge port 90. Alternately, an optional discharge of conditioned air 100 for delivery to an interior space.

In heat exchanger exhaust section 2*a*, return air 105, comprising return air from an interior space, outside air, or any combination thereof is drawn through heat exchanger return air port 111 by means of suction provided by forced air exhaust blower 140. An optional return air port 115 is provided in chassis 10 for return air 105 from an interior space. Air exhaust blower 140 further draws return air 105 through air filter 30, air exhaust blower 140, and forces return air 105 through optional evaporative elements 120, rotary regenerative heat exchanger wheel 60, through heat exchanger exhaust air port 151 wherein heat exchanger exhaust air 161 enters recirculation duct 230 and flows into desiccant exhaust section 2b where at natural gas/or oil burner 220 further heats exhaust air 161 as it flows into desiccant exhaust section 2b. Heat exchanger exhaust air 161 is further forced through desiccant exhaust return air port 112, desiccant wheel 50, and desiccant exhaust air 162 exits system through desiccant exhaust port 152.

Required electrical disconnect 170 and control section 180 comprising required control circuitry, sensors, plumbing and wiring necessary for proper system operation, desiccant wheel rotary motive power and mechanical apparatus 190 as well as heat exchanger rotary motive power and mechanical apparatus 200 are also provided, but not shown.

In the operation of heat exchanger exhaust section 2a, return air 105 is drawn into heat exchanger return air port 111 through air filter 30, by action of exhaust air blower 140, further forcing return air 105 through optional evaporative elements 120 wherein return air 5 is evaporatively cooled, through rotary regenerative heat exchanger wheel 60, wherein cooled return air 105 removes heat and lowers the temperature of the structure of rotary regenerative heat exchanger wheel exhaust sector 62 of rotary regenerative heat exchanger wheel 60, as previously described under FIG. 2, and heat exchanger exhaust air 161 is discharged to an exterior space through heat exchanger exhaust air port 151.

In the operation of desiccant exhaust section 2b, system input air 5 is heated by enclosed burner 210, drawn into desiccant exhaust intake 112, through air filter 30, by action of exhaust air blower 140, further forcing heated system input air 5 through the exhaust sector 52 of desiccant wheel 50, heating and drying, thereby regenerating the desiccant and desiccant exhaust air 162 is discharged to an exterior space through heat exchanger exhaust air port 152.

In the heating mode, the optional evaporative elements 120, desiccant wheel 50, and desiccant exhaust section 2b are disabled. System input air 5 enters the outside air intake 202,3,4 and passes through air filter 30. Forced air intake blower 40 draws filtered system input air 5 from air filter 30, pressurizes it and forces the filtered system input air 5 through the balance of the supply section 1. The filtered heated system input air 5 is further heated as it passes through heating coil 70, wherein enclosed burner 210 provides heat to heating coil 70. Desiccant wheel 50 is disabled, and does not substantially alter the temperature, moisture content or enthalpy of system input air 5 passing therethrough. Axially and rotatably mounted and motor driven rotary regenerative heat exchanger wheel 60 is substantially equally divided into a supply sector 61 and an exhaust sector 62. The filtered system input air 5 passes through the supply sector 61 of the rotary regenerative heat exchanger wheel 60 and heat contained in the structure of the rotary regenerative heat exchanger wheel 60 is transferred to and increases the temperature of the filtered system input air 5. Conditioned air 100 exits side discharge port 90 disposed to conventional HVAC ductwork provides the pathway for heated, conditioned air 100 to enter interior space.

In heat exchanger exhaust section 2a, return air 105 is drawn through heat exchanger return air port 111 and filter 30 by means of suction provided by forced air exhaust blower 140. Air exhaust blower 140 further forces return air 105 through disabled optional evaporative elements 120, rotary regenerative heat exchanger wheel 60, wherein return air 105 passes through the exhaust sector 62 of the rotary regenerative heat exchanger wheel 60 transferring heat to the structure of the rotary regenerative heat exchanger wheel 60, forcing heat exchanger exhaust air 161 through heat exchanger exhaust air port 151 to exterior space.

Further provided is an improved air conditioning system for admitting air from a space, adjusting the temperature and humidity of the air, delivering the adjusted air to an interior space of a structure, and removal of exhaust air therefrom and return of the exhaust air to the space, comprising, a first path for conditioning air including a first air intake means for admitting air to be conditioned. An air supply first blower means communicates with said first air intake means for receiving, pressurizing and moving the air from said first air intake means. A desiccant means is rotatable through a first zone and second zone. The first zone communicates with said air supply first blower means and receiving the pressurized exterior air from said exterior air supply first blower means for reducing the humidity by means of reducing the water vapor content of the air passing therethrough. A heat exchanger means has a first area for accepting heat and a second area for rejecting heat, wherein said first area of said heat exchanger means communicates with said desiccant means for receiving the air with reduced water vapor content from said desiccant means for downwardly adjusting the temperature of air displaced therethrough. A heating means communicates with said heat exchanger means for receiving the cooled reduced water vapor content air from said heat exchanger means for optionally upwardly adjusting the temperature of air displaced therethrough. A conditioned first air exit means communicates with said heating means for receiving the temperature and humidity adjusted air from said heating means and communicating with the interior space of a structure for delivery thereto.

A second path independent of the first path for indirect evaporative cooling of air includes a second air intake means for accepting air from a space with said second area of said heat exchanger thereadjacent wherein the accepted air passes over said second area and removes heat from said second area of said heat exchanger means. A second air blower means communicates with said second area for receiving and moving air from said second area of said heat exchanger means. A second air exit means communicates with said second air blower means for receiving second air from said second air blower means and communicating with the exterior of the structure for delivery of the second air thereto.

A third path, independent of the first path and second path for regeneration of desiccant air includes a third air intake means. A heater is associated therewith and the second zone of said desiccant means wherein said desiccant means communicates with said regenerated third air intake means for regeneration of said desiccant means by transfer of water vapor and subsequent removal. A third regeneration air exit means communicates with said second zone of said desiccant means for receiving regeneration air from said second zone of said desiccant means for delivery of the regeneration air thereto.

Figure 8:
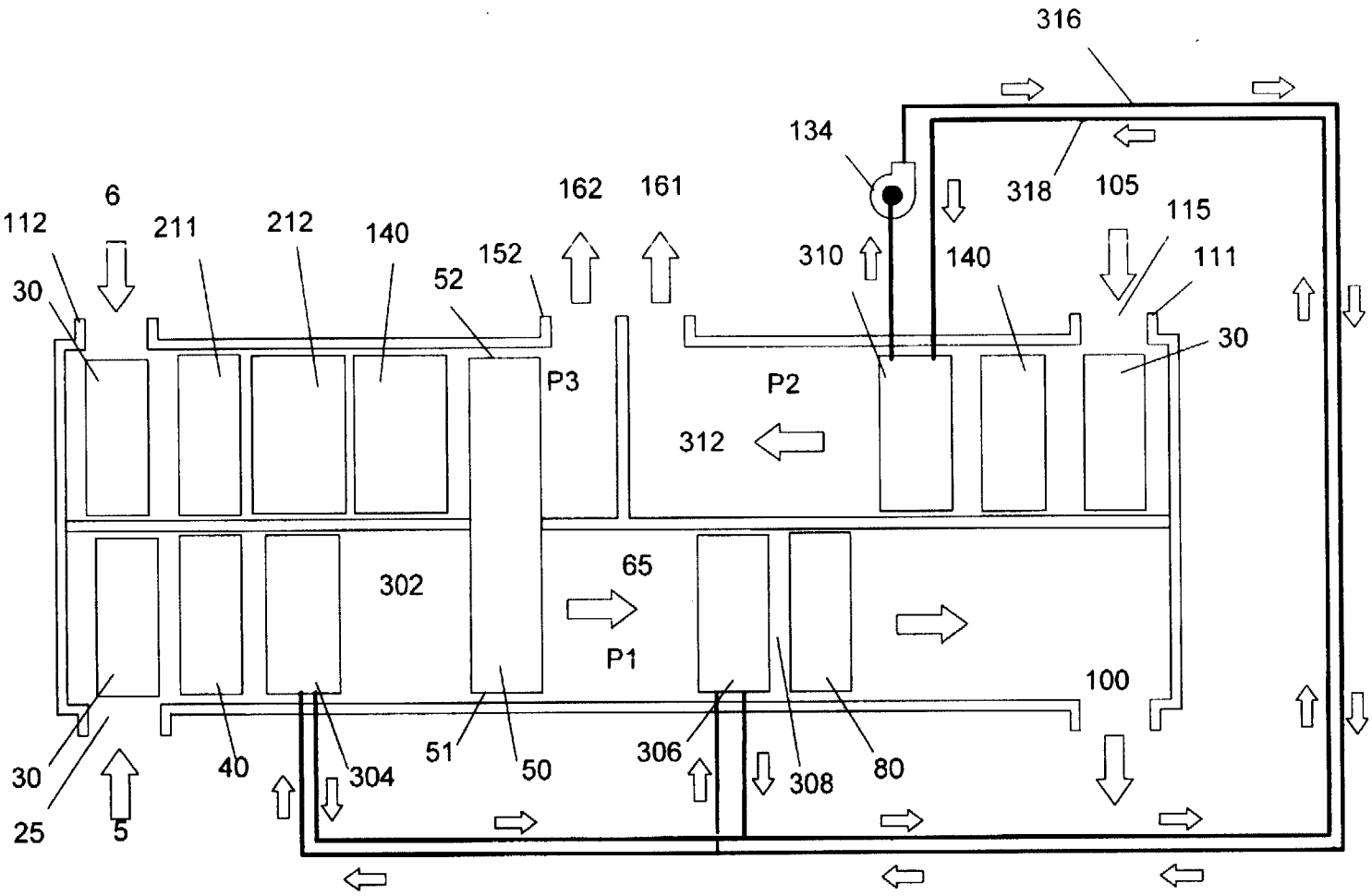
FIG. 8 is block diagram of a sixth embodiment of the invention.

Shown in FIG. 8 is a sixth embodiment of the invention. In such embodiment, a three path system is employed. Such system is for admitting air from a space, adjusting the temperature and humidity of the air, and delivering the adjusted air to an interior space of the structure. The system has a first path P-1 for conditioning air. Such path includes a first air intake 5 for admitting air to be conditioned. An air supply first blower 40 is in communication with the first air intake for receiving, pressurizing and moving the air from the first air intake. A precooling heat exchanger coil 304 is next provided for precooling the air received from the first air intake. A desiccant wheel 50 is next provided. Such wheel is rotatable through a first zone 51 and second zone 52. The first zone is in communication with the air supply first blower. It receives the precooled air from the exterior air supply first blower for reducing the humidity by means of reducing the water vapor content of the air passing therethrough. A recooling heat exchanger coil 306 is next provided for cooling the air with reduced water vapor content from the desiccant wheel. This is for downwardly adjusting the temperature of air displaced therethrough to thereby maintain the absolute humidity of the air at the region 308 after the recooling coil. The same as the region 65 prior to the recooling coil. A humidifier coil 80 is next provided to add moisture to the recooled air. Lastly provided in the first path is a conditioned first air exit 100 communicating with the humidifier coil for receiving the temperature and humidity adjusted air from the humidifier coil and communicating with the interior space of a structure for delivery thereto.

A second path P-2, independent of the first path, is next provided for indirect evaporative cooling of air. Such second path includes a second air intake 105 for accepting air from a space. A second air blower 140 is in communication with the second area for receiving and moving air through the second path. A second air exit 161 communicates with the second air blower for receiving second air from the second air blower. It is in communication with the exterior of the structure for delivery of the second air thereto. A package cooling tower pad 310 is next provided in the second path. Such pad has an output feed line 316 and pump 314 coupled to the input of both the precooling coil and the recooling coil. The pad also has an input return line 318 coupled to the output of both the precooling coil and the recooling coil.

A third path P-3, independent of the first path and second path is next provided for regeneration of desiccant air. Such third path includes a third air intake 6, condenser coil 211, hot water coil 212 and blower 140 associated therewith. Also in the third path is the second zone of the desiccant wheel wherein the desiccant wheel communicates with the regenerated third air intake for regeneration of the desiccant wheel by the transfer of water vapor and subsequent removal. Also at the third path is a third regeneration air exit 162 in communication with the second zone 52 of the desiccant wheel for receiving regeneration air from the second zone 52 of the desiccant wheel.

Figure 9:
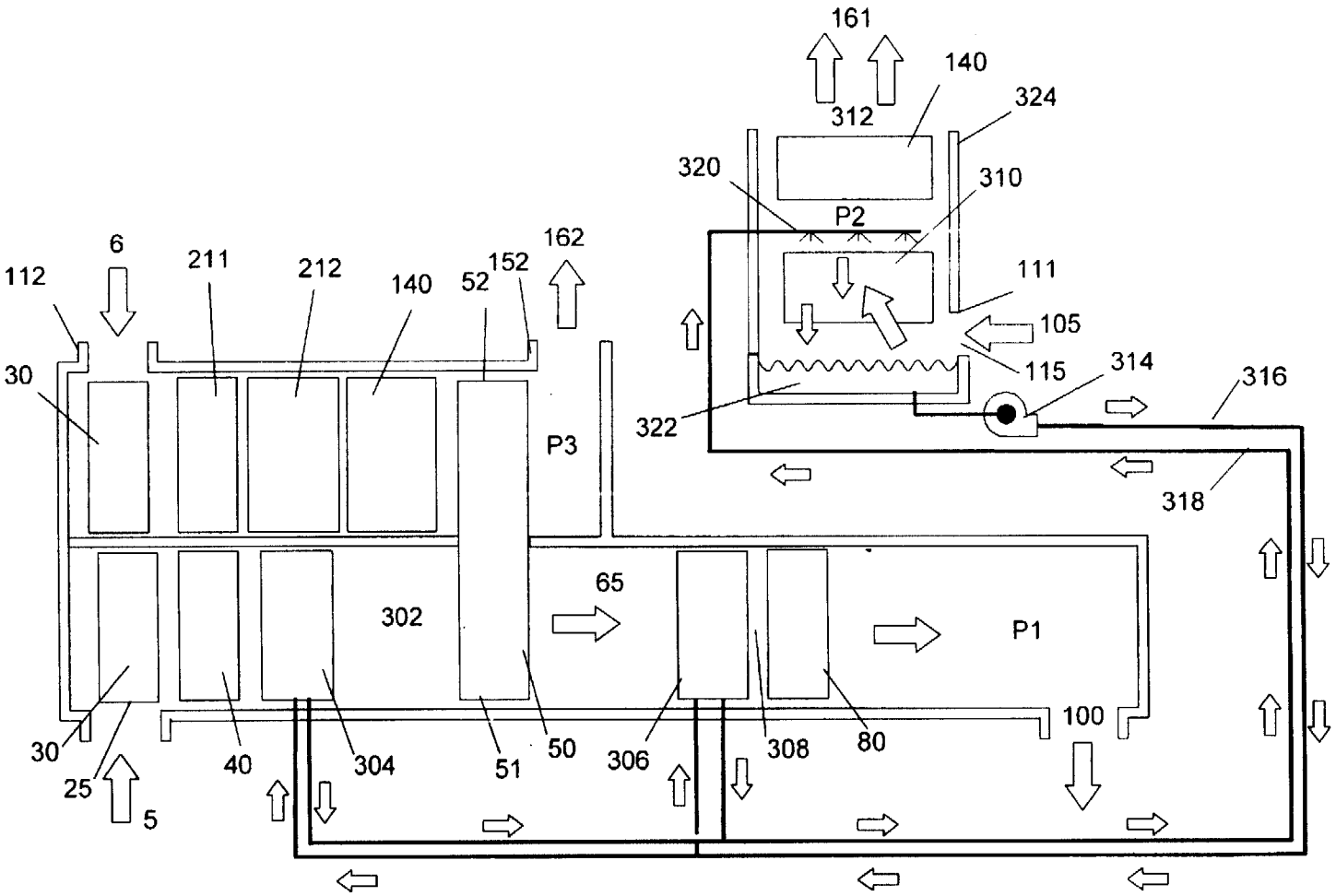
FIG. 9 is a block diagram of a seventh embodiment of the invention.

The embodiment of FIG. 9 is also an improved air conditioning system similar to that of FIG. 8. The first and third feed paths are identical. The second path, however, is different. The second path P-2 of the FIG. 9 embodiment is independent of the first path and remote therefrom for indirect evaporative cooling of air. Such path includes a second air intake 105 for accepting air from a space. A second air blower 140 is in communication with the second area for receiving and moving air through the second path. A second air exit 161 is in communication with the second air blower for receiving saturated second air from the second air blower. It is in communication with the exterior of the structure for delivery of the second air thereto. The second path also has, in association therewith, a split cooling tower 324 with a pad 310. The tower is part of the second path. In association with the tower is an output feed line 316 and pump 314. Such line and pump are coupled to the input of both the precooling coil and the recooling coil. In addition, an input return line 318 is coupled to the output of both the precooling coil and the recooling coil. Such line terminates at a water sprinkler 320 configurated and located to effect the flow of water over the cooling tower pad 310. The water collects into a cool water storage 322 therebeneath.

In the last two embodiments, the use of precooling and recooling improves the dehumidification process when compared against the prior embodiments and the prior art. The improved dehumidification, in turn, results in an increase of efficiency with more drying of the air with less energy input.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention. Now that the invention has been described,

What is claimed is:

1. An improved air conditioning system for admitting air from a space, adjusting the temperature and humidity of the air, and delivering the adjusted air to an interior space of a structure, comprising:

a first path for conditioning air including a first air intake means for admitting air to be conditioned;

an air supply first blower means communicating with said first air intake means for receiving, pressurizing and moving the air from said first air intake means;

a precooling heat exchanger coil for precooling the air received from the first air intake means;

a desiccant wheel rotatable through a first zone and second zone, the first zone communicating with said air supply first blower means and receiving the precooled air from said exterior air supply first blower means for reducing the humidity by means of reducing the water vapor content of the air passing therethrough;

a recooling heat exchanger coil for cooling the air with reduced water vapor content from said desiccant wheel for downwardly adjusting the temperature of air displaced therethrough to thereby maintain the absolute humidity of the air at the region after the recooling coil as the region prior to the recooling coil;

a humidifier coil to add moisture to the recooled air;

a conditioned first air exit means communicating with said humidifier coil for receiving the temperature and humidity adjusted air from said humidifier coil and communicating with the interior space of a structure for delivery thereto;

a second path independent of the first path for indirect evaporative cooling of air including a second air intake means for accepting air;

a second air blower means for receiving and moving air through the second path;

a second air exit means communicating with said second air blower means for receiving second air from said second air blower means and communicating with the exterior of the structure for delivery of the second air thereto;

a cooling tower pad in the second path with an output feed line and pump coupled to the input of the precooling coil and recooling coil and an input return line coupled to the output of the precooling coil and recooling coil;

a third path, independent of the first path and second path for regeneration of desiccant air including a third air intake means, condenser coil, hot water coil and blower associated therewith and the second zone of said desiccant wheel wherein said desiccant wheel communicates with said regenerated third air intake means for regeneration of said desiccant wheel by transfer of water vapor and subsequent removal; and a third regeneration air exit means communicating with said second zone of said desiccant wheel for receiving regeneration air from said second zone of said desiccant wheel.

2. An improved air conditioning system for admitting air from a space, adjusting the temperature and humidity of the air, delivering the adjusted air to an interior space of a structure, a first path for conditioning air including a first air intake means for admitting air to be conditioned;

an air supply first blower means communicating with said first air intake means for receiving, pressurizing and moving the air from said first air intake means;

a precooling heat exchanger coil for precooling the air received from the first air intake means;

a desiccant wheel rotatable through a first zone and second zone, the first zone communicating with said air supply first blower means and receiving the precooled air from said exterior air supply first blower means for reducing the humidity by means of reducing the water vapor content of the air passing therethrough;

a recooling heat exchanger coil for cooling the air with reduced water vapor content from said desiccant wheel for downwardly adjusting the temperature of air displaced therethrough to thereby maintain the absolute humidity of the air at the region after the recooling coil as the region prior to the recooling coil;

a humidifier coil to add moisture to the recooled air;

a conditioned first air exit means communicating with said humidifier coil for receiving the temperature and humidity adjusted air from said humidifier coil and communicating with the interior space of a structure for delivery thereto;

a second path independent of the first path and remote therefrom for indirect evaporative cooling of air including a second air intake means for accepting air;

a second air blower means for receiving and moving air through the second path;

a second air exit means communicating with said second air blower means for receiving saturated second air from said second air blower means and communicating with the exterior of the structure for delivery of the second air thereto;

a cooling tower with a pad in the second path with an output feed line and pump coupled to the input of the precooling coil and recooling coil and an input return line coupled to the output of the precooling coil and recooling coil and terminating at a water sprinkler for the flow of water over the cooling tower pad into a cool water storage therebeneath;

a third path, independent of the first path and second path for regeneration of desiccant air including a third air intake means, condenser coil, hot water coil and blower associated therewith and the second zone of said desiccant wheel wherein said desiccant wheel communicates with said regenerated third air intake means for regeneration of said desiccant wheel by transfer of water vapor and subsequent removal; and a third regeneration air exit means communicating with said second zone of said desiccant wheel for receiving regeneration air from said second zone of said desiccant wheel.

3. An improved air conditioning system for admitting air, adjusting the temperature and humidity of the air, and delivering the adjusted air to an interior space of a structure comprising:

a first path for conditioning air including a first air intake means for admitting air to be conditioned;

an air supply first blower means communicating with the first air intake means for receiving, pressurizing and moving the air from the first air intake means;

a desiccant means movable through a first zone and second zone, the first zone communicating with the air supply first blower means and receiving the pressurized air moved by the exterior air supply first blower means for reducing the humidity by means of reducing the water vapor content of the air passing therethrough;

a heat exchanger means having a first area for accepting heat and a second area for rejecting heat, wherein the first area of the heat exchanger means communicates with the desiccant means for receiving the air with reduced water vapor content from the desiccant means for downwardly adjusting the temperature of air displaced therethrough;

a conditioned first air exit means communicating with the heat exchanger means for receiving the temperature and humidity adjusted air and communicating with the interior space of a structure for delivery thereto;

a second path independent of the first path including a second air intake means with the second area of the heat exchanger thereadjacent wherein the accepted air passes over the second area and removes heat from the second area of the heat exchanger means;

a second air blower means for receiving and moving air from the second area of the heat exchanger means;

a second air exit means communicating with the second air blower means for receiving second air from the second air blower means;

a third path, independent of the first path and second path for regeneration of desiccant air including a third air intake means, a heater associated therewith and the second zone of the desiccant means wherein the desiccant means communicates with the regenerated third air intake means for regeneration of the desiccant means; and a third regeneration air exit means communicating with the second zone of the desiccant means for receiving regeneration air from the second zone of the desiccant means for delivery of the regeneration air thereto.

* * * * *